US005634363A

United States Patent [19]

Shozaki et al.

[11] Patent Number: 5,634,363

[45] Date of Patent: Jun. 3, 1997

[54] METHOD OF MECHANICAL DESCALING AND MECHANICAL DESCALING EQUIPMENT

[75] Inventors: Tamotsu Shozaki; Kozo Katsube; Mamoru Murahashi; Katsumasa Tanaka; Yasuhiro Oki, all of Kobe, Japan

[73] Assignee: Kabushiki Kaisha Kobe Seiko Sho, Kobe, Japan

[21] Appl. No.: 493,131

[22] Filed: Jun. 21, 1995

[30] Foreign Application Priority Data

Jun. 30, 1994 [JP] Japan ..... 6-150021
Jun. 30, 1994 [JP] Japan ..... 6-150022
Jun. 30, 1994 [JP] Japan ..... 6-150023

[51] Int. Cl.[6] ..... B21C 19/00

[52] U.S. Cl. ..... 72/39; 72/64; 72/278

[58] Field of Search ..... 29/81.04; 72/39, 72/40, 68, 77, 78, 79, 278, 64

[56] References Cited

U.S. PATENT DOCUMENTS 1,538,325 5/1925 Higgins ..... 72/79
2,928,164 3/1960 Span ..... 72/39

FOREIGN PATENT DOCUMENTS 170441 6/1994 Japan ..... 29/81.04
2109717 6/1983 United Kingdom ..... 72/39

*Primary Examiner*—Lowell A. Larson
*Attorney, Agent, or Firm*—Oblon, Spivak, McClelland, Maier & Neustadt, P.C.

[57] ABSTRACT

In a bending type mechanical descaling method, streak-like scales remain, which cause a die seizure in the subsequent drawing process. In the present invention, there is provided a quite new mechanical descaling technique capable of eliminating such streak-like scales. The new mechanical descaling method includes the step of passing a metal wire through a torsion generating portion for forcibly turning the metal wire around the axial center thereof while running the metal wire, thereby removing scales due to a difference in toughness between the metal wire and scales.

8 Claims, 14 Drawing Sheets

COMPARISON IN LUBRICANT STICKING AMOUNT BETWEEN CONVENTIONAL METHOD AND INVENTIVE METHOD 0.93C STEEL φ5.5 → 2.2mm, 400m/min, Na SERIES LUBRICANT

METHOD OF MECHANICAL DESCALING AND MECHANICAL DESCALING EQUIPMENT

BACKGROUND OF THE INVENTION

1. Field of the Invention

The present invention relates to a method of mechanically removing scales (oxidizing film) on the surface of a metal wire and an apparatus thereof, and particularly to a quite new descaling technique of removing scales of a metal wire by imparting a torsion to the metal wire.

2. Description of the Related Art

A hot-rolled wire or a metal wire in the course of processing such as patenting is exposed to an oxidizing atmosphere at a high temperature by an intermediate heat-treatment performed in the manufacturing process, and thereby it is stuck with scales on the surface. The scales must be perfectly removed because they cause, for example, the seizure of a die in the subsequent drawing process.

The scales are removed by a chemical method (acid pickling) and mechanical method (mechanical descaling). The former, however, has been not prevailed so much because it must be provided with a waste liquid treatment equipment for eliminating pollution problems. On the contrary, the latter has come to be extensively applied because it does not require any waste liquid treatment equipment. In general, there have been known two mechanical descaling methods: (1) a reverse bending method of allowing a running wire to pass through several rollers for repeatedly bending/returning it; and (2) a shot blasting method of acceleratively jetting small particles from a nozzle using compressed air for blasting them on the surface of the metal wire.

The above-described methods, however, have the following disadvantages. For example, in the reverse bending method, the repeated bending/returning cannot be uniformly applied to a metal wire along its whole periphery, and thereby untreated scales remain on part of the surface of the metal wire.

FIG. 17 is a view illustrating the whole concept of the reverse bending method. A metal wire 5 runs from the left to the right in a box 6. The interior of the box 6 is partitioned into a reverse bending portion 8 and a brushing portion 9 by means of a partitioning plate 7. The metal wire 5 is bent in the different directions in the course of passing through a group of rollers (first roller 1, second roller 2, third roller 3 and fourth roller 4 disposed in this order). Namely, scales are removed using a different in toughness between the metal wire 5 and scales. At the brushing portion 9, residual scales are removed using wire wheels. Next, the metal wire 5 discharged from the box 6 is, for example, drawn through a die (not shown).

FIGS. 18A to 18F are views each illustrating the contact state between the metal wire 5 and each of the rollers 1 to 4, seen from front side or upper side of the apparatus shown in FIG. 17. Referring to FIG. 18A (seen from the front side), the upper peripheral surface (shown by the mark ●) of the metal wire 5 is press-contacted with a lower side peripheral surface la of a first roller 1, and both side peripheral surfaces (shown by the marks ▲, Δ) are not contacted with the peripheral surface of the roller.

Next, in FIG. 18B (seen from the front side), since the axial center of the second roller 2 is disposed to be in parallel to the axial center of the first roller 1, the metal wire 5 is bent in the direction reversed to the bending direction by the first roller 1. As a result, the portion shown by the mark ○ on the sided opposed to the portion shown by the mark ● is contacted with an outer peripheral surface 2*a* of the second roller 2. FIG. 18C shows the second roller 2 from the upper side, in which the portion shown by the mark ○ is contacted with the outer peripheral surface 2*a* of the second roller 2. In FIG. 18D (seen from the upper side), the metal wire 5 is shifted from the second roller 2 to the third roller 3.

The second roller 2 is disposed such that the axial center is perpendicular to that of the third roller 3. The reason for this is that in the case where the metal wire 5 runs between the rollers in parallel to each other as shown in the first and second rollers 1 and 2, the contact point of the metal wire 5 with the roller is repeatedly shifted only between the portions shown by the marks ● and ○, that is, the metal wire 5 is repeatedly bent only in the reversed directions. As a result, the contact point is not changed into the portions shown by the marks ▲ and Δ, to limit the scale removing directions, thus causing a fear that non-treated portions remain. In the actual operation, however, since the metal wire 5 is already imparted with the bending deformation in the specified direction, and exhibits a large resistance against the bending along the other direction. For this reason, the metal wire 5 is simply twisted by 90° while being restricted in the outer groove of each of the rollers 2, 3. Accordingly, the metal wire 5 is apparently turned by 90° clockwise (horizontal direction in the figure) by the twisting effect of −90° against the bending by 180°, and in such a state, it reaches the third roller 3. Consequently, in FIG. 18D (seen from the upper side), the portion shown by the mark ● of the metal wire 5 is closely contacted with an outer peripheral surface 3*a* of the roller. In this way, in the case of the actual reverse bending operation, there occurs an inconvenience that the contact point with the outer peripheral surface of the roller is not satisfactorily changed.

Moreover, in FIG. 18E in which the fourth roller 4 is disposed such that the axial center thereof is perpendicular to that of the third roller 3, the metal wire 5 is apparently turned by 90° counterclockwise (vertical direction in the figure) by the twisting effect of +90° against the bending by 180°, and in such state, it reaches the fourth roller 4. Consequently, in FIG. 18E (seen from the upper side) and FIG. 18F (seen from the front side), the portion shown by the mark ○ is contacted with a peripheral surface 4*a* of the roller, and consequently, the contact point is not also changed into the portion shown by the marks ▲ and Δ. Thus, in the course where the metal wire 5 is carried from the first roller 1 to the fourth roller 4, it is usually subjected to the repeated bending within the same surface, which causes a serious disadvantage in which the removable of scales is limited to a specified portion.

On the other hand, the shot blasting method is high in scale removing effect as compared with the reverse bending method, but it is disadvantageous in that the blasting efficiency to a metal wire having a small diameter is low and that the equipment cost is increased.

On the other hand, the method of forcibly applying a displacement such as bending to the metal wire 5 requires a means for preventing the propagation of the return action of the displacement. In general, the means includes a press-contact rollers 63, 64 and 65, each having a small diameter, disposed between pinch rollers 61 and 62 as shown in FIG. 19. In this means, however, since the diameter of each roller is small, the contact area between a metal wire and each press-contact roller cannot be sufficiently ensured, so that the contact pressure between the metal wire and the press-contact roller is excessively increased and thereby the metal wire come to be contacted with the press-contact roller nearly at one point. As a result, there is a fear that scratches are generated on the surface of the metal wire. Accordingly, a technique of certainly preventing the propagation of the return action of the displacement has been required.

The metal wire subjected to mechanical descaling is fed to the subsequent process, for example, drawing process. In this case, since the drawing rate of the metal wire is not constant, the method of imparting a single displacement amount fails to uniformly remove scales. Namely, in the actual operation, it is necessary to examine a variation in the running speed of a metal wire.

OBJECT AND SUMMARY OF THE INVENTION

An object of the present invention is to provide a quite new mechanical descaling technique capable of solving the disadvantages in the conventional mechanical descaling method such as the reverse bending method.

Another object of the present invention is to provide a torsion propagation preventive mechanism capable of preventing the propagation of a torsion without generation of any scratch on a metal wire.

A further object of the present invention is to provide a mechanical descaling apparatus capable of uniformly removing scales depending on a variation in the running speed of a metal wire.

To achieve the above object, according to a first invention, there is provided a mechanical descaling method for removing scales on the surface of a metal wire, comprising the step of:

passing said metal wire through a torsion generating portion for forcibly turning said metal wire around the axial center thereof while running said metal wire, thereby removing scales due to a difference in toughness between said metal wire and scales.

According to a second invention, there is provided a mechanical descaling apparatus comprising:

a torsion generating portion for turning, a displacing/running portion for curvedly running a metal wire along the peripheral surface of a roller, around the axial center of said metal wire in the carrying direction; and a torsion propagation preventive portion for applying a restriction to said metal wire from a peripheral portion of said metal wire under the running state thereby preventing the propagation of a torsion, which is provided on the upstream side from said torsion generating portion.

The torsion propagation preventive portion may be provided on the downstream side from said torsion generating portion.

According to a third invention, there is provided a mechanical descaling apparatus, wherein two of said torsion generating portions are provided along the running direction of said metal wire in such a manner that said torsion generating portion on the upstream side is turned in the reverse direction to that of said torsion generating portion on the downstream side at a speed lower than that of said torsion generating portion on the downstream side, thereby canceling the torsions obtained by said torsion generating portions on the upstream and downstream sides.

The torsion propagation preventive portion may be provided on the downstream side from said torsion generating portion on the downstream side.

Each invention is characterized by forcibly turning a metal wire around its axial center while running the metal wire. In the turning, the metal wire is imparted with a torsion because of its sufficient toughness; but scales stuck on the surface of the metal wire cannot follow the torsion because they have little toughness. As a result, a removing force is generated between the metal wire and scales, thus dropping the scales from the surface of the metal wire. In each invention, moreover, it becomes possible to effectively remove scales on the surface of a metal wire which has been regarded as being difficult to be mechanically descaled, such as a high strength metal wire, particularly, a medium or high carbon steel wire, or an alloy steel wire containing Cr, Ni, Si, Co and the like.

The mechanism for generating a torsion is not particularly limited so long as the torsion is generated by rotation of the running metal wire around its axial center while slightly displacing the running locus. The torsion propagation preventive portion provided on the upstream side and/or the downstream side from the torsion generating portion preferably has a first, second and third rollers whose axial centers are disposed approximately in a triangular shape so that said metal wire is bypassed approximately in a U-shape, and said third roller has a specified contact length with said metal wire. The specified contact length of said third roller can be obtained by specifying the diameter of said third roller at 120 mm or more, and a contact angle of said third roller with said metal wire at 90° or more.

The torsion propagation preventive portion having the above-described construction is effective to prevent the propagation of a torsion without generation any scratch on a metal wire upon mechanical descaling, and to eliminate the necessity of adjustment of the pressing amounts of press-contact rollers.

According to a fourth invention, there is provided a mechanical descaling apparatus having a torsion generating portion for forcibly turning a metal wire around the axial center of said metal wire while running said metal wire thereby feeding said metal wire imparted with a torsion to a drawing machine, comprising:

a drawing rate detecting means for detecting a drawing rate of said metal wire in the range of from said torsion generating portion to said drawing machine;

a torsion amount storing means for previously storing a specified torsion amount; and a torsional rotation frequency control means for calculating a specified torsion rotational frequency on the basis of a drawing rate detected from said drawing rate detecting means and said torsion amount read out from said torsion amount storing means thereby rotating said torsion generating portion in accordance with said calculated torsional rotation frequency. The torsion amount is a distance of said metal wire running for one rotation around the axial center of said metal wire.

In the fourth invention, the torsional rotation frequency is calculated on the basis of the detected drawing rate and the torsion amount read out from the torsion amount storing means. The torsional rotation frequency is increased when the drawing rate is changed on the (+) side (advance side); while it is decreased when the drawing rate is changed on the (−) side (delay side). As a result, it becomes possible to usually obtain the scale removing effect even when the drawing rate is changed.

In addition, the drawing rate or the torsional rotation frequency are expressed in an analog signal or digital signal.

DETAILED DESCRIPTION OF THE PREFERRED EMBODIMENTS

Hereinafter, embodiments of the present invention will be described with reference to the drawings.

Torsion Generating Portion

Figure 1:
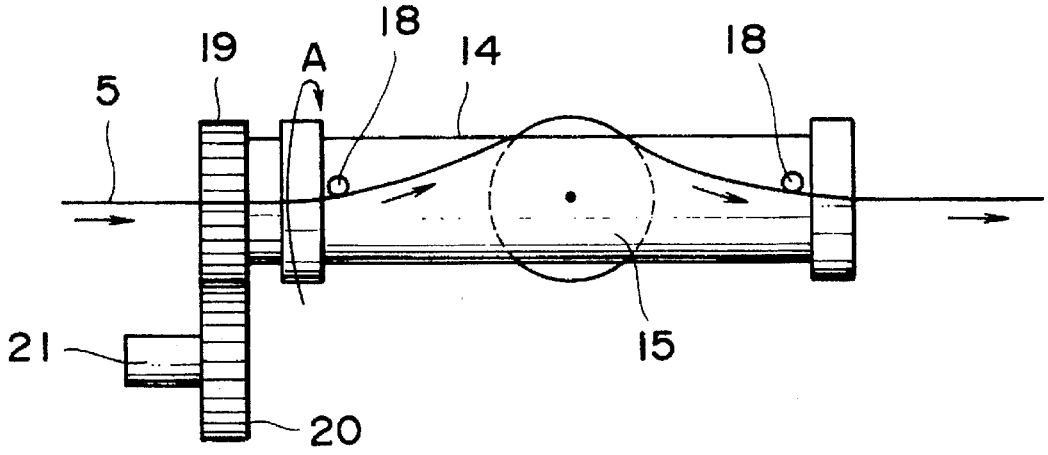
FIG. 1 is a view of a torsion generating portion used in a mechanical descaling method according to the first invention.
Figure 2:
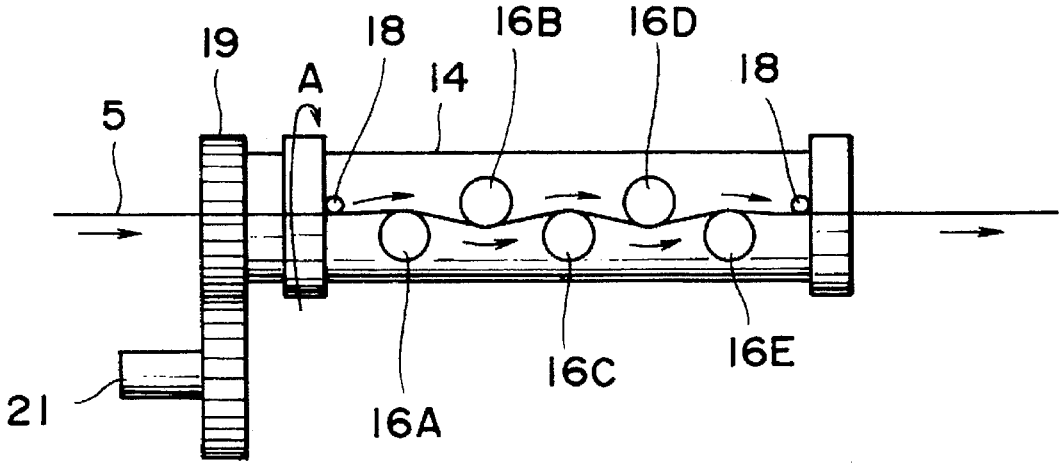
FIG. 2 is a view of another example of the torsion generating portion.
Figure 3A:
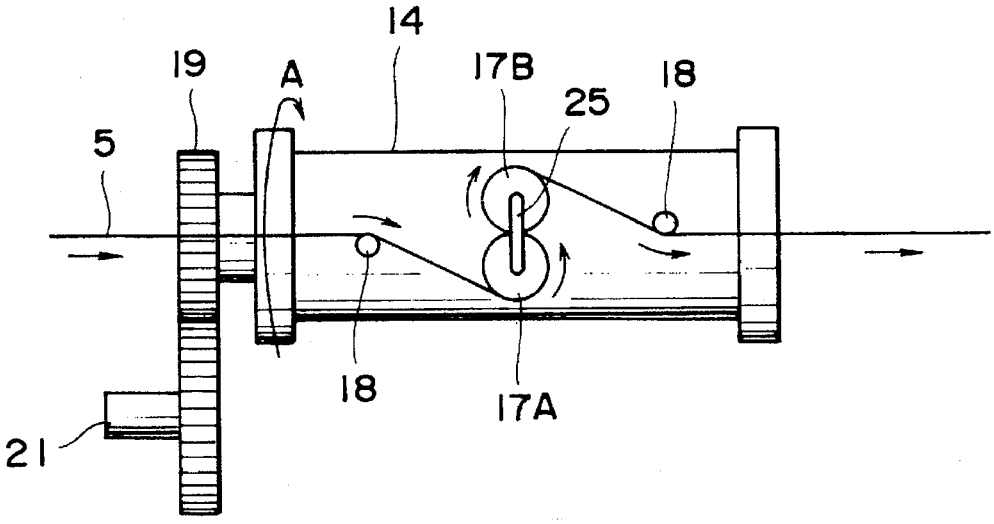
FIGS. 3A to 3D are views of a further example of the torsion generating portion.
Figure 3B:
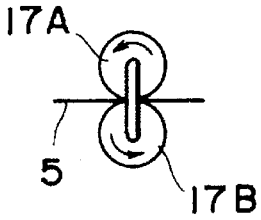
Figure 3C:
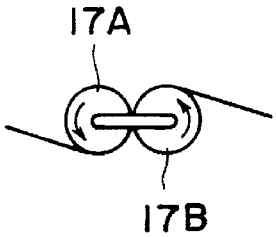
Figure 3D:
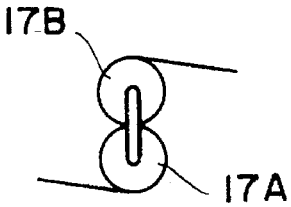

FIGS. 1 to 3 show the constructions of torsion generating portions used for a mechanical descaling method of a first invention. In each of the torsion generating portions, a cylindrical casing 14 contains and rotatably supports a metal wire displacing roller 15 (hereinafter, referred to as a "displacing roller") (see FIG. 1); displacing rollers 16A to 16D (see FIG. 2); or displacing rollers 17A to 17B (see FIGS. 3A to 3D). At the inlet end and outlet end of the casing 14, center guide rollers 18, 18 are provided for guiding a metal wire 15 so as not to be shifted from the axial center of the casing 14.

A gear 19 provided around the outer periphery of the inlet end portion of the casing 14 is connected to a rotation shaft 21 of a motor through a transmission gear 20, so that the casing 14 in each example shown in FIGS. 1, 2 and 3A to 3D can be turned in the direction of the arrow A. The displacing roller 15, displacing rollers 16A to 16D, and displacing rollers 17A and 17B shown in respective figures can be thus turned in the direction of the arrow A.

The displacing roller 15 shown in FIG. 1 is disposed at the axial center of the casing 14; the displacing rollers 16A to 16D shown in FIG. 2 are disposed in such a manner as to be symmetric to each other relative to the axial line of the casing 14; and the displacing rollers 17A and 17B shown in FIGS. 3A to 3D are disposed in such a manner as to be symmetric to each other relative to the axial center of the casing 14. In the present invention, however, they may be disposed in such a manner as to be symmetric to each other relative to a point or line shifted from the axial center or the axial line of the casing 14, or may be disposed in such a manner as not to be symmetric to each other.

In addition, the arrangement of the rollers 17A and 17B shown in FIGS. 3A to 3D is preferably of a structure in which a connecting bar 25 rotatably connecting the rollers 17A and 17B to each other can be rotated by 180° counterclockwise by way of the steps shown in FIG. 3(*b*)→FIG. 3(*c*)→FIG. 3(*d*). In such a structure, the metal wire 5 can be extremely easily allowed to pass between the rollers 17A and 17B from the stand-by state shown in FIG. 3(*b*). After that, the connecting bar 25 is rotated counterclockwise by 90° to be shifted in the state shown in FIG. 3(*c*). It is further rotated counterclockwise by 90° to be shifted in the state shown in FIG. 3(*d*). The operating state shown in FIG. 3(*a*) can be thus extremely easily obtained.

Torsion Propagation Preventive Portion

Figure 4A:
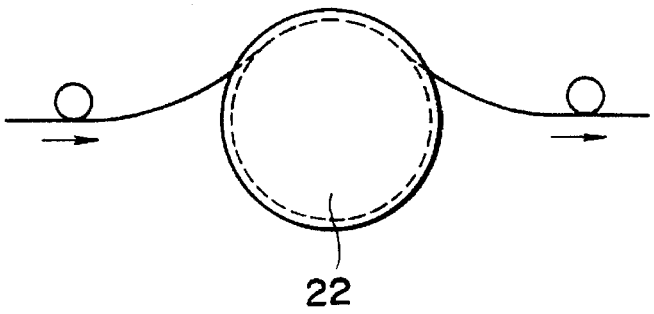
FIGS. 4A and 4B are views of a torsion propagation preventive portion.
Figure 4B:
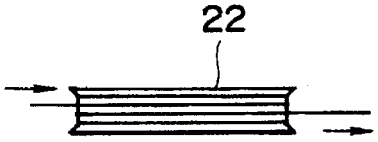
Figure 5:
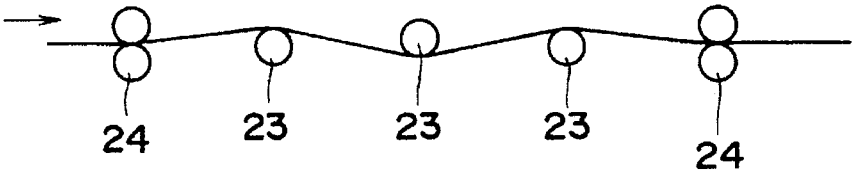
FIG. 5 is a view of another example of the torsion propagation preventive portion.

FIGS. 4A, 4B and 5 show basic constructions of torsion propagation preventive portions. FIG. 4A is a front view of a grooved roller 22; and FIG. 4B is a plan view of the grooved roller 22. In the construction shown in these figures, the metal wire 5 is wound around the grooved roller 22 by at least one turn, and thereby the metal wire 5 is applied with a restriction from a peripheral portion of the metal wire 5 without obstruction of the running of the metal wire 5, thus preventing the torsion propagation.

FIG. 5 shows the construction in which a plurality of press-contact rollers 23 are eccentrically disposed between pinch rollers 24, 24, whereby the metal wire 5 is applied with a restriction from a peripheral portion of the metal wire 5, thus preventing the torsion propagation by the functions of the rollers 23.

Figure 6:
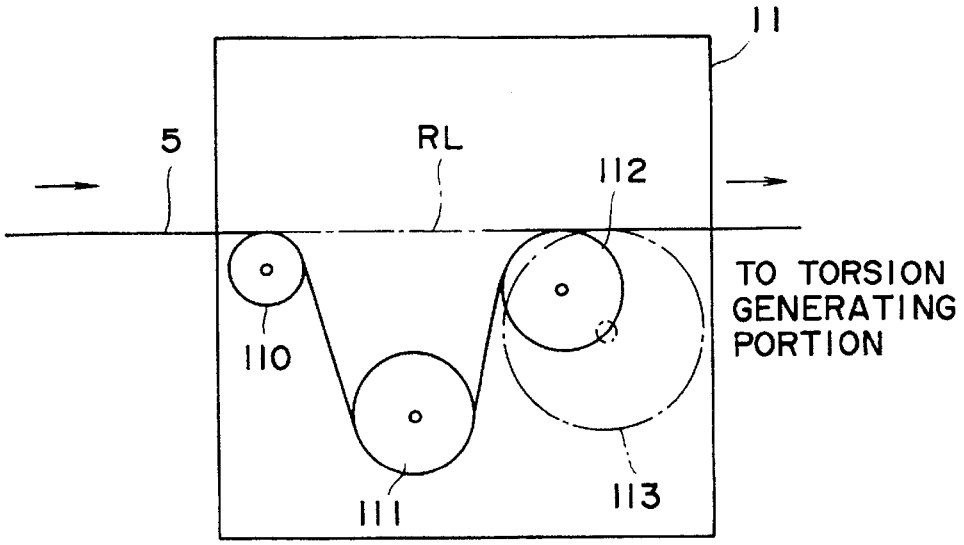
FIG. 6 is a typical view showing a preferred construction of the torsion propagation portion.

FIG. 6 shows a construction for certainly preventing the torsion propagation of a metal wire irrespective of the diameter of the metal wire. In this figure, a torsion propagation preventive portion 11 has a first roller 110, second roller 111, and a third roller 112 whose axial centers are disposed approximately in a triangular shape such that the metal wire 5 is bypassed approximately in a U-shape. The second roller 111 is disposed so as to be approximately intermediate between the first roller 110 and the third roller 112, and to be separated downward from the running path (shown by a dashed line RL in the figure).

The first, second and third rollers 110, 111, 112 have diameters 75, 120, and 120 mm, respectively, and they have fixed at the shaft portions thereof. According to the torsion propagation preventive portion 11 having the above-described roller arrangement, since the metal wire 5 runs while being bypassed in the U-shape, it becomes possible to prevent the torsion propagation without any adjustment of pressing amounts of press-contact rollers as the conventional method.

The torsion propagated from the torsion generating portion 12 is directly applied to the third roller 112; however, since the diameter of the third roller 112 is set to be larger than the conventional one (40 mm) and the contact length between the metal wire 5 and the third roller 112 is set to be sufficiently longer, the metal wire can run on the third roller 112 having a large contact area at a small contact pressure, with a result that the metal wire 5 can be prevented from being damaged on the surface.

The relationship between a roller diameter and a contact angle is examined, and the result is shown in Table 1.

TABLE 1

| roller | contact angle (°) between metal wire and press-contact roller | | | | | |
|---|---|---|---|---|---|---|
| | 30 | | 90 | | 120 | |
| diameter (mm) | propagation of torsion | scratch | propagation of torsion | scratch | propagation of torsion | scratch |
| ϕ40 | ○ | presence | ○ | presence | ○ | presence |
| ϕ75 | ○ | presence | ○ | presence | ○ | presence |
| ϕ100 | ○ | presence | ○ | presence | ○ | absence |
| ϕ120 | ○ | presence | ○ | absence | ○ | absence |
| ϕ200 | ○ | presence | ○ | absence | ○ | absence |

Figure 7:
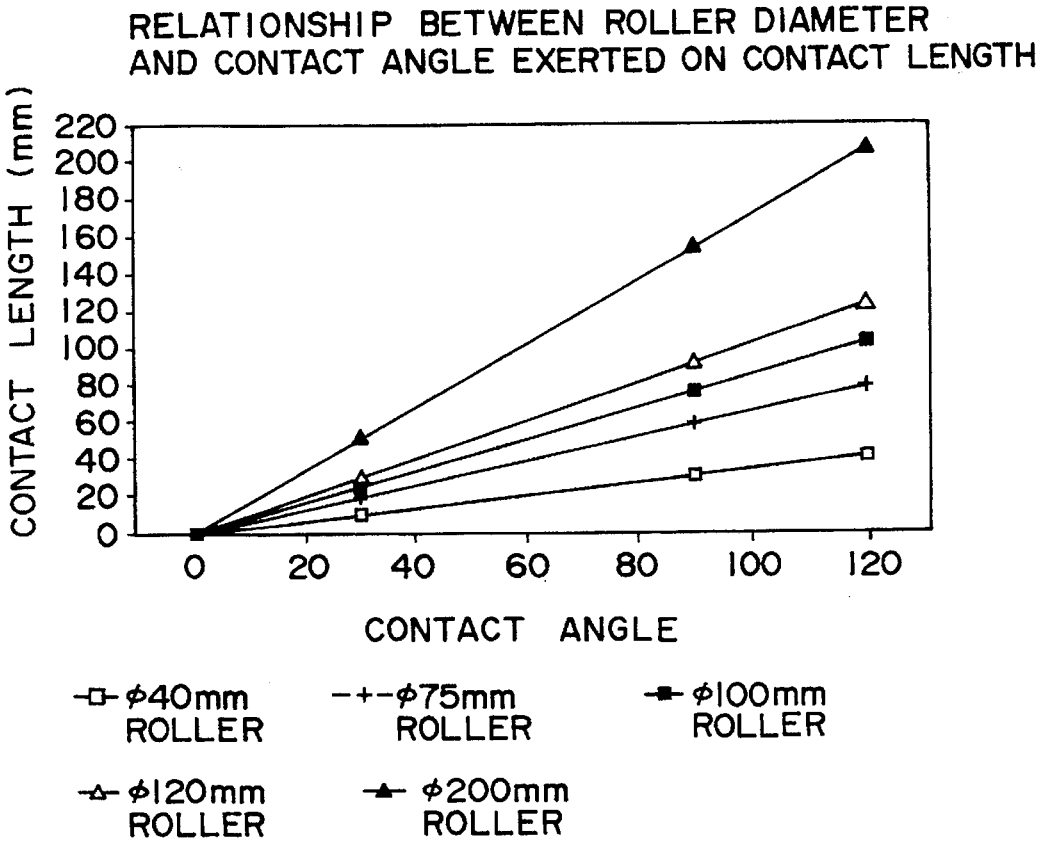
FIG. 7 is a graph showing the contact length of the torsion propagation portion.

○: propagation of torsion, being prevented
"presence": scratch is present on the surface of metal wire
"absence": scratch is absent on the surface of metal wire As is apparent from Table 1, even in the case of a large roller diameter, when a contact angle is small, scratches are generated. On the other hand, in the case of a small roller diameter, even when a contact angle is large, scratches are generated. Accordingly, to determine the specification of the press-contact roller (second roller), both the roller diameter and contact angle are required to be specified as follows:

Namely, it is necessary to satisfy the requirement of roller diameter ≧ϕ120 mm and contact angle ≧90°. FIG. 7 shows the relationship between the roller diameter and contact angle exerted on the contact length obtained under the above-described requirement. As is apparent from FIG. 7, the contact length of 94 mm or more can be ensured. In addition, although scratches are not generated even in the case where the roller diameter is ϕ200 mm and the contact angle is 120°, this case is poor in the practical use, and thereby it is insufficient for determining a good specification of the press-contact roller. In FIG. 6, reference numeral 113 indicates the case where a roller having a diameter of ϕ200 mm is disposed.

In this embodiment, a contact length is specified by a roller diameter and a contact angle; however, it is not limited thereto, and a contact length may be directly specified. Moreover, the torsion propagation preventive portion in this embodiment may be disposed on each of the upstream and downstream sides from a torsion generating portion, and it may be disposed only on the upstream side from a torsion generating portion.

Whole Construction

Figure 8:
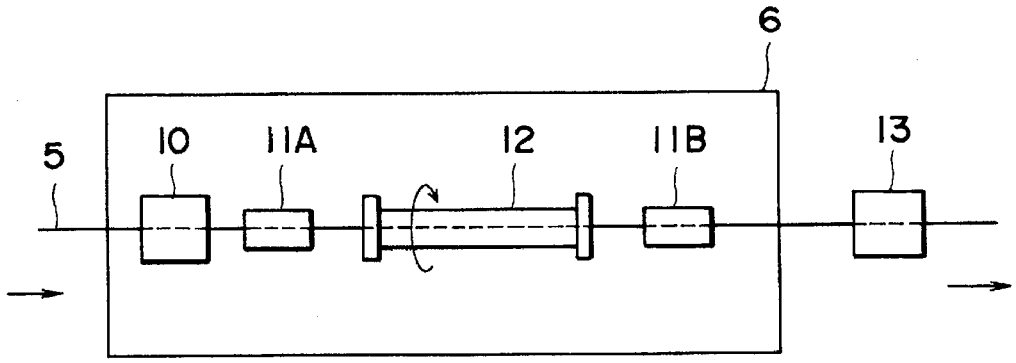
FIG. 8 is a view showing the whole construction of a mechanical descaling apparatus of a second invention.
Figure 9:
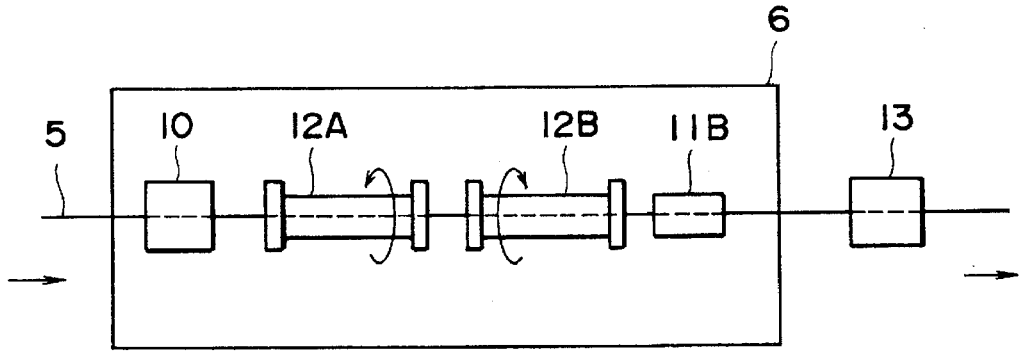
FIG. 9 is a view showing the whole construction of a mechanical descaling apparatus of a third invention.

FIG. 8 shows a mechanical descaling apparatus according to the first invention, and FIG. 9 shows a mechanical descaling apparatus according to the second invention.

Referring to FIG. 8, the mechanical descaling apparatus has a torsion generating portion 12 for turning a displacing/running portion of curvedly running a metal wire 5 along the peripheral surface of a roller, around the axial center of the metal wire 5 in the carrying direction; and torsion propagation preventive portions 11A and 11B provided on the upstream and downstream sides so as to put the torsion generating portion 12 therebetween for applying a restriction to the metal wire 5 from a peripheral portion of the metal wire 5 in the running state. A correcting portion 10 for imparting a tension to the metal wire 5 is provided on the upstream side of the torsion propagation preventive portion 11A. These components are contained in a box 6, and a die box 13 is provided on the downstream side of the box 6.

In this construction, the metal wire 5 applied with a tension is imparted with a torsion by the torsion generating portion 12, and by the effect of the torsion propagation preventive portions 11A, 11B provided on the upstream and downstream sides of the torsion generating portion 12, the metal wire 5 is discharged from the box 6 in the state that the torsion of the metal wire 5 is fixed, and it enters the die box 13 for drawing. Here, to enhance the entrainment of a lubricant to a drawing die, and to further improve the drawability, the torsion propagation preventive portion 11B may be omitted.

Next, the mechanical descaling apparatus shown in FIG. 9 will be described. In addition, parts corresponding to those shown in FIG. 8 are indicated at the same characters, and the explanation thereof is omitted.

The apparatus shown in FIG. 9 has two torsion generating portions 12A and 12B. The torsion generating portion 12A on the upstream side is turned in the reversed direction to that of the torsion generating portion 12B on the downstream side at a speed lower than that of the torsion generating portion 12B, thereby canceling the torsions generated by the torsion generating portions 12A and 12B. On the other hand, a torsion propagation preventive portion 11B having the same construction as that shown in FIG. 8 is provided on the downstream side from the torsion generating portion 12B.

Figure 10:
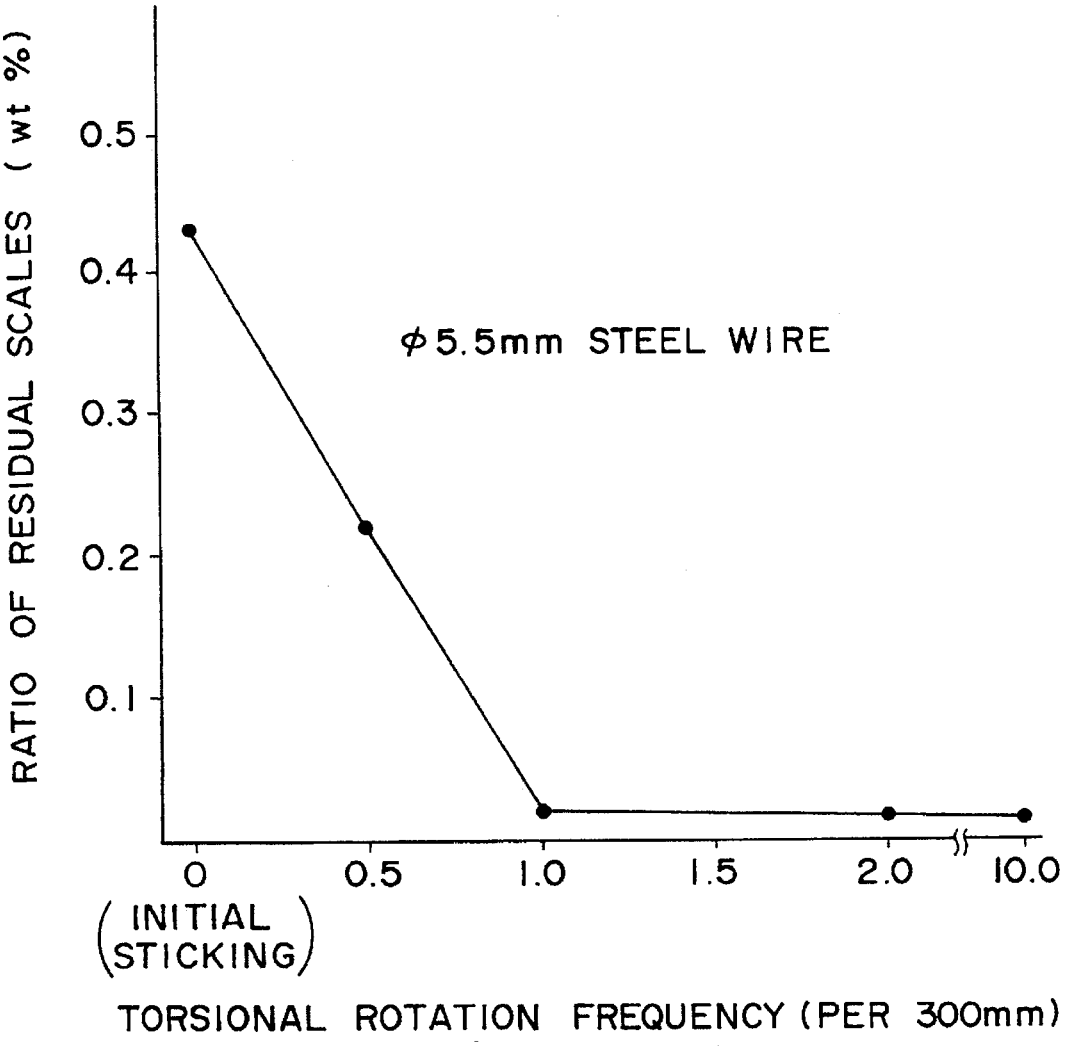
FIG. 10 is a graph showing the scale removing effect of the mechanical descaling method of the present invention.

FIG. 10 is a graph showing the result of removing scales using such a mechanical descaling apparatus. In this figure, the abscissa indicates the torsional rotation frequency per 300 mm of a metal wire, and the ordinate indicates the ratio of residual scales (wt %). The following metal wire having a diameter of 5.5 mm was subjected to descaling using a roller having a diameter of 85 mm. At this time, the additional strain is calculated by the following equation.

$$\begin{aligned}\text{Additional strain} &= \text{wire diameter}/(\text{roller diameter} + \text{wire diameter}) \times 100 \\ &= [5.5/(85+5.5)] \times 100 \\ &= 6.1\%\end{aligned}$$

Chemical composition:

C: 0.92%, Si: 0.25%, Mn: 0.48%, Cr: 0.02%, Ni: 0.02%
P: 0.008%, S: 0.009%

Pre-treatment: direct rolling/patenting

Scale sticking amount: 0.42 wt %

As shown in FIG. 10, the ratio of residual scales is abruptly decreased when the torsional rotation frequency is more than one turn/300 mm. Consequently, in the subsequent drawing process, the generation of the die seizure is extremely reduced.

In addition, the decrease in the ratio of residual scales is saturated at the torsional rotation frequency of one turn/300 mm, and accordingly, the torsional rotation frequency is not required to be increased more than the value. When the torsional rotation frequency is more than two turns/300 mm, a strain amount due to the torsion is increased, to generate a waviness, tending to exert adverse effect on the subsequent drawing process. However, since a preferred range of the torsional rotation frequency is dependent on the strength .and diameter of a metal wire, it is not particularly specified in the present invention.

Table 2 shows the mechanical descaling result in this embodiment performed at the torsional rotation frequency of one turn/300 mm and the drawing result. In addition, for comparison, the result of the conventional bending type mechanical descaling using the same metal wire and the drawing result are shown in Table 2.

In each case, after mechanical descaling, a metal wire having a diameter of 5.5 mm was drawn into a diameter of 3.0 mm through five dies using a calcium stearate series lubricant.

TABLE 2

| Method | remaining state of scales | drawing rate | drawing amount and result |
|---|---|---|---|
| Inventive Example | amount of residual scales (initial) 0.02 wt % | 250 m/min | no die seizure |
| | residual scales after treatment present a little (dotted scales) 300 mm/each rotation | 350 m/min | no die seizure |
| Conventional Example | amount of residual scales (initial) 0.025 wt % | 250 m/min | No. 3 die generation of seizure at 200 kg |
| | residual scales after treatment present (streak-like scales) (width: 1.5 mm, length: about 200 mm, and pitch: about 1.5 mm) two points on the same circumference (180° C.) | 350 m/min | No. 2 die generation of seizure at 150 kg |

As shown in Table 2, in the conventional bending system, scales in an amount to cause the die seizure remain; while in the mechanical desclaing method of the present invention, any seizure is not generated for all of the dies even when the drawing rate is increased.

According to the present invention, therefore, it becomes possible to effectively perform mechanical descaling for a metal wire regarded as being difficult to be subjected to mechanical descaling, such as a high strength metal wire, particularly, a medium/high steel wire, or an alloy wire containing Cr, Ni, Si Co and the like.

Moreover, even in the apparatus shown in FIG. 9, the torsion propagation preventive portion 11B on the downstream side can be omitted for further improving the entrainment of a lubricant to a drawing die.

Control of Torsion Amount in Torsion Generating Portion

Figure 11:
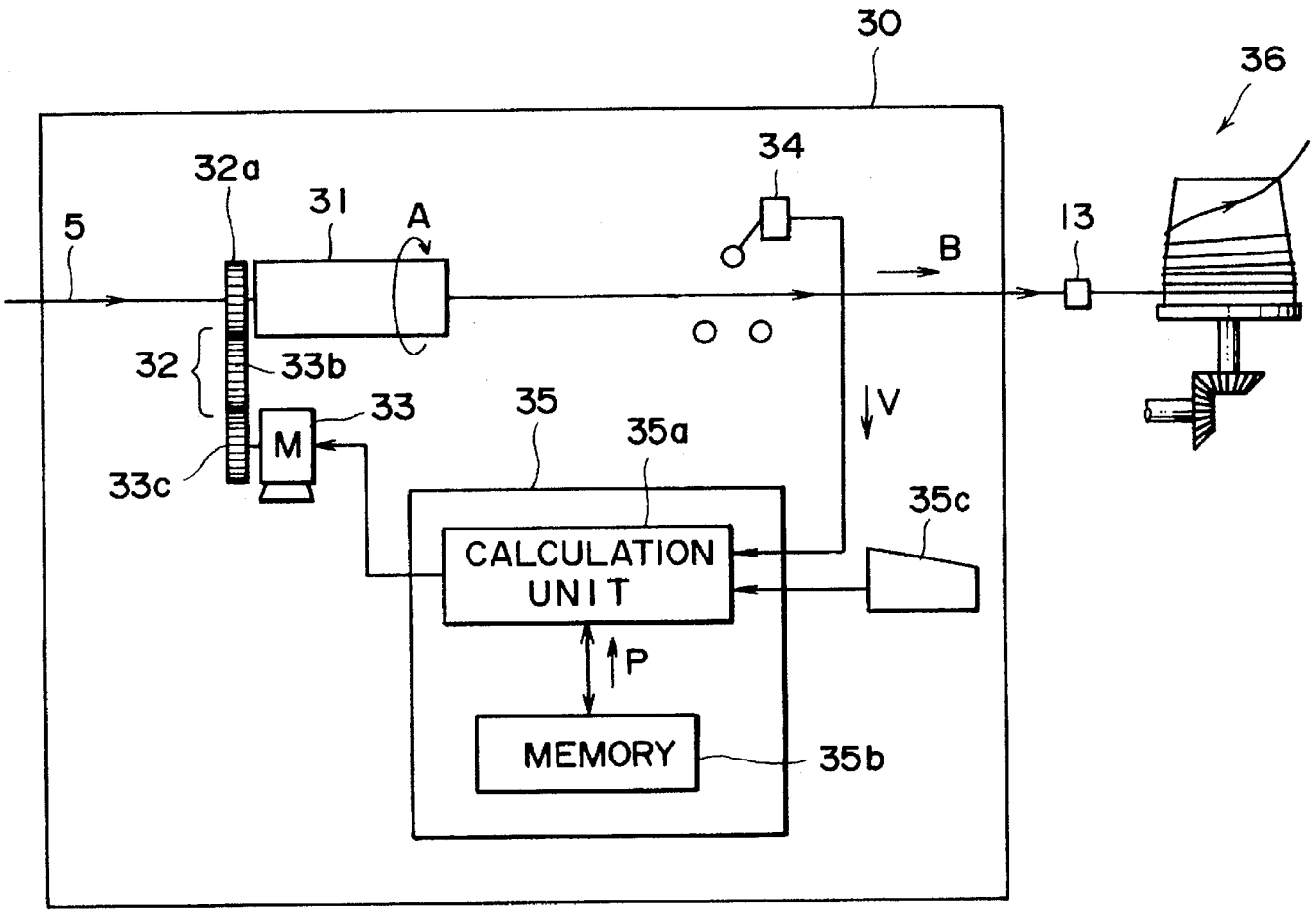
FIG. 11 is a block diagram showing the construction of a fourth invention.

FIG. 11 shows a fourth invention, which includes a mechanical descaling apparatus 30; and a die box 13 and a drawing machine 36 provided on the downstream side from the mechanical descaling apparatus 30.

In the figure, the mechanical descaling apparatus 30 includes a torsion generating portion 31 for forcibly turning a metal wire 5 around the axial center thereof while running the metal wire 5; a drive motor 33 for imparting a rotational force to the torsion generating portion 31 through a gear unit 32; a detecting device 34 for detecting a drawing rate; and a control circuit 35 as a torsional rotation frequency control means for controlling a rotation frequency of the drive motor 33.

Hereinafter, the construction of each part will be described in detail. In addition, the construction of the torsion generating portion is the same as described above.

A gear **32*a* provided at one end of the torsion generating portion 31 is meshed with a rotational shaft gear 33*c* of the drive motor 33 through a transmission gear 33*b*, so that the torsion generating portion 31** can be turned in the direction of the arrow A.

The detecting device for detecting a drawing rate is composed of a contact type touch roll speed detecting device which is adapted to detect a drawing rate of the metal wire 5 running from the torsion generating portion 31 to the drawing machine 36 and to supply a drawing rate signal to the control circuit 35. In addition, the detecting device 34 may be composed of a non-contact type laser or charging speed detecting device.

The control circuit 35 is composed of a microcomputer having a calculating unit **35*a* and a memory 35*b* as a torsion amount storing means, which is adapted calculate a torsional rotation frequency N on the basis of a drawing rate V outputted from the detecting device 34 and a torsion amount P read out from the memory 35*b*** in accordance with the following equation.

$$N(rpm)=V(mm/min)/P(mm)$$

The torsion rotation frequency thus obtained is converted into a control signal and is inputted in the drive motor 33 for controlling the rotating speed of the drive motor 33. Accordingly, the drive motor 33 can be of a type capable of being controlled in its rotation such as an invertor motor. In the figure, reference numeral **35*c* indicates an input device for setting a torsion amount. The torsion amount inputted from the input device 35*c* is stored (set) in the memory 35*b*. Here, the torsion amount means a running distance of the metal wire 5 during one rotation of the metal wire 5** around its axial center.

The operation of this embodiment having the above-described construction will be described above. In addition, it is assumed that the torsion amount is inputted from the input device **35*c* before the apparatus is operated, and it is stored in the memory 35*b***.

In FIG. 11, when the torsion generating portion 31 and the drawing machine 36 are in the operating states and the metal wire 5 runs in the direction of the arrow B, the drawing rate of the metal wire 5 is continuously detected by the detecting device 34, and the detected drawing rate is inputted in the control circuit 35. In the control circuit 35, the torsional rotation frequency N is calculated on the basis of the inputted drawing rate V and the torsion amount P previously stored in the memory **35*b*, and the rotating speed of the drive motor 33 is controlled on the basis of the resultant torsional rotation frequency N. Specifically, when the drawing rate V is changed on the (+) side (advance side), the calculated torsional rotation frequency N becomes higher, to increase the rotation of the drive motor 33, thus increasing the rotating speed of the torsion generating portion 31. On the contrary, when the drawing rate V is changed on the (−) side (delay side), the calculated torsional rotation frequency N becomes lower, to lower the rotation of the drive motor 33, thus decreasing the rotating speed of the torsion generating portion 33**.

In the above-described embodiment, the torsion amount is inputted from the input device; however, it is suitably selected from those previously stored in the memory in accordance with the kinds and diameters of the metal wires.

Application to Drawing Equipment

Figure 12:
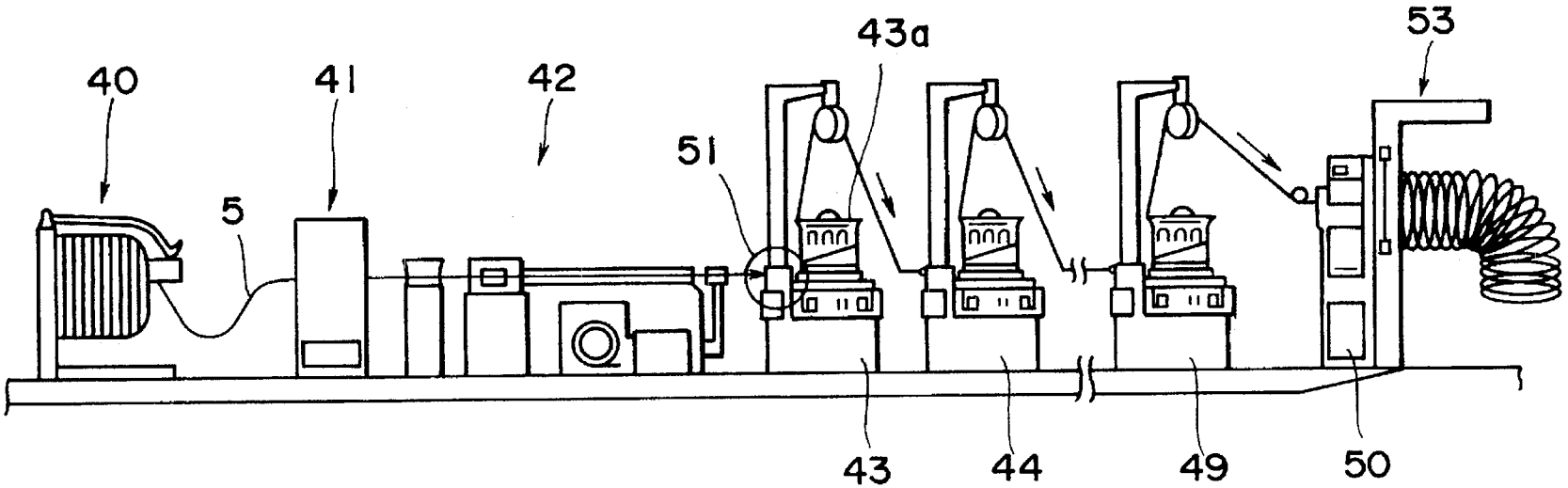
FIG. 12 is a schematic view showing the inventive mechanical descaling apparatus combined with a drawing machine.

FIG. 12 is a schematic view showing the construction of the case where the mechanical descaling apparatus of the present invention is applied to the front stage of a drawing machine.

In the figure, the metal wire 5 supplied from a wire supply device 40 is supplied to a mechanical descaling apparatus 41, and enters a first drawing machine 43 through a borax film forming apparatus 42 for forming a film on the surface of the metal wire. In this embodiment, the metal wire is continuously drawn by a row of a first drawing machine 43, second drawing machine 44 . . . seventh drawing machine 49 and eighth drawing machine 50 (third to sixth drawing machines are not shown for simplicity).

Figure 13:
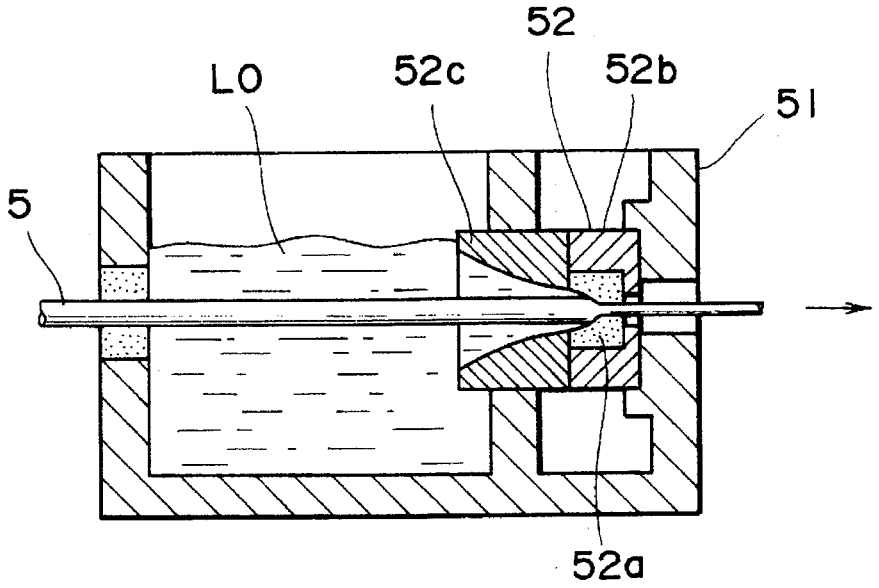
FIG. 13 is a sectional view of a lubricant box of a drawing machine.

As shown in FIG. 13, the first drawing machine 43 includes a lubricant box 51. A die 52 composed of a cemented carbide alloy tip 52*a*, die case 52*b* and a die pressing piece 52*c* is contained in the lubricant box 51. A lubricant LO is stored on the inlet side of the die 52, and the metal wire 5 passing through the lubricant LO is introduced in the inlet of the die 52.

The metal wire 5 discharged from the lubricant box 51 runs around a first drawing shuttle 43*a*, and enters the second drawing machine 44, and further sequentially advances through the third to eighth drawing machine. Thus, the metal wire 5 is drawn in a desired diameter, and is wound around a winder 53 in a coil shape.

Figure 14:
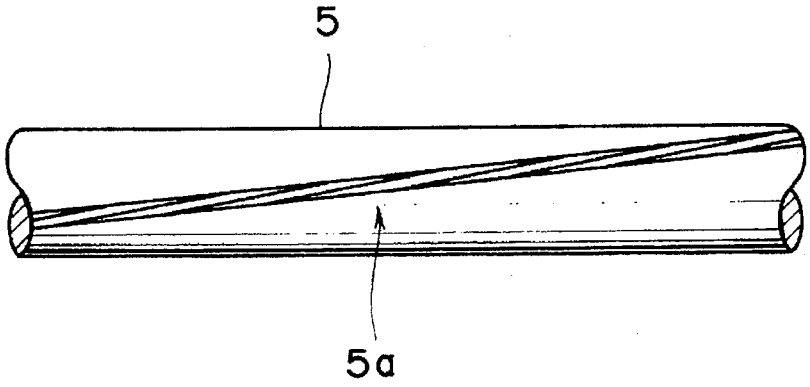
FIG. 14 is a typical view showing the torsion of a metal wire.

In the front stage of the lubricant box 51, the metal wire 5 is imparted with a continuous torsion by the torsion type mechanical descaling apparatus 41, so that when passing through the lubricant LO and the die 52, the metal wire 5 is rotated around its axis such that the torsion is released. As shown by the torsion line 5*a* in FIG. 14, the metal wire 5 is imparted with a torsion by forcibly turning the metal wire 5 around its axis. The torsion amount in this embodiment is changed depending on a drawing condition such as a drawing rate; however, in the case where a torsion of about 360° is imparted to the metal wire 5, the metal wire 5 is rotated once around its axis for each span ranging from 800 to 2000 mm.

When the metal wire is distorted, irregularities are generated on the surface, and the lubricant LO enter the irregularities, to thus increase the amount of the lubricant LO applied to the die 52. Moreover, since the metal wire 5 advances toward the die 52 in the lubricant box 51 while being rotated in the rewinding direction, there occurs a phenomenon that the lubricant LO is entrained. As a result, the lubricant amount stuck on the metal wire 5 can be kept at a high level, and even a high strength material can be drawn at a high drawing rate.

In FIG. 12, the metal wire 5 supplied from the wire supply apparatus 40 is imparted with a continuous torsion by the torsion type mechanical descaling apparatus 41 for removing scales. The metal wire 5 from which scales are removed is then subjected to borax film forming treatment, and is supplied through the die 52 while being distorted. At this time, the metal wire 5 is rotated due to a torsional recovery force (a force for returning the torsion to the original) between the mechanical descaling apparatus 41 and the die 52 (more specifically, between the mechanical descaling apparatus 41 and the first drawing shuttle 43*a*).

Next, equipments have been made for explaining the reason why the mechanical descaling apparatus of the present invention is suitable for the drawing machine.

a) Experimental Condition kind of steel: 0.92%C carbon steel (wire diameter: 5.5 mm) pre-treatment for drawing:

Conventional Method (for comparison)

bending type mechanical descaling+borax film forming treatment

Inventive Method torsion type mechanical descaling+borax film forming treatment (torsion amount=about 360°/2000 mm span)

drawing lubricant: Na series lubricant drawing size: wire diameter 5.5 mm→2.2 mm (eight dies)

die schedule: see Table 3

TABLE 3

| die No. | 1 | 2 | 3 | 4 | 5 | 6 | 7 | 8 |
|---|---|---|---|---|---|---|---|---|
| die diameter mm | 4.8 | 4.2 | 3.7 | 3.3 | 2.95 | 2.65 | 2.4 | 2.2 |

b) Experimental Result drawing possible rate (judged by the degree of die seizure): see Table 4

TABLE 4

| drawing rate mm/min | 250 | 375 | 400 | 425 |
|---|---|---|---|---|
| Conventional Example | ○ | X | X | X |
| Inventive Example | ○ | ○ | ○ | Δ |

○: no die seizure
Δ: slight die coarsening
X: die seizure

Figure 15:
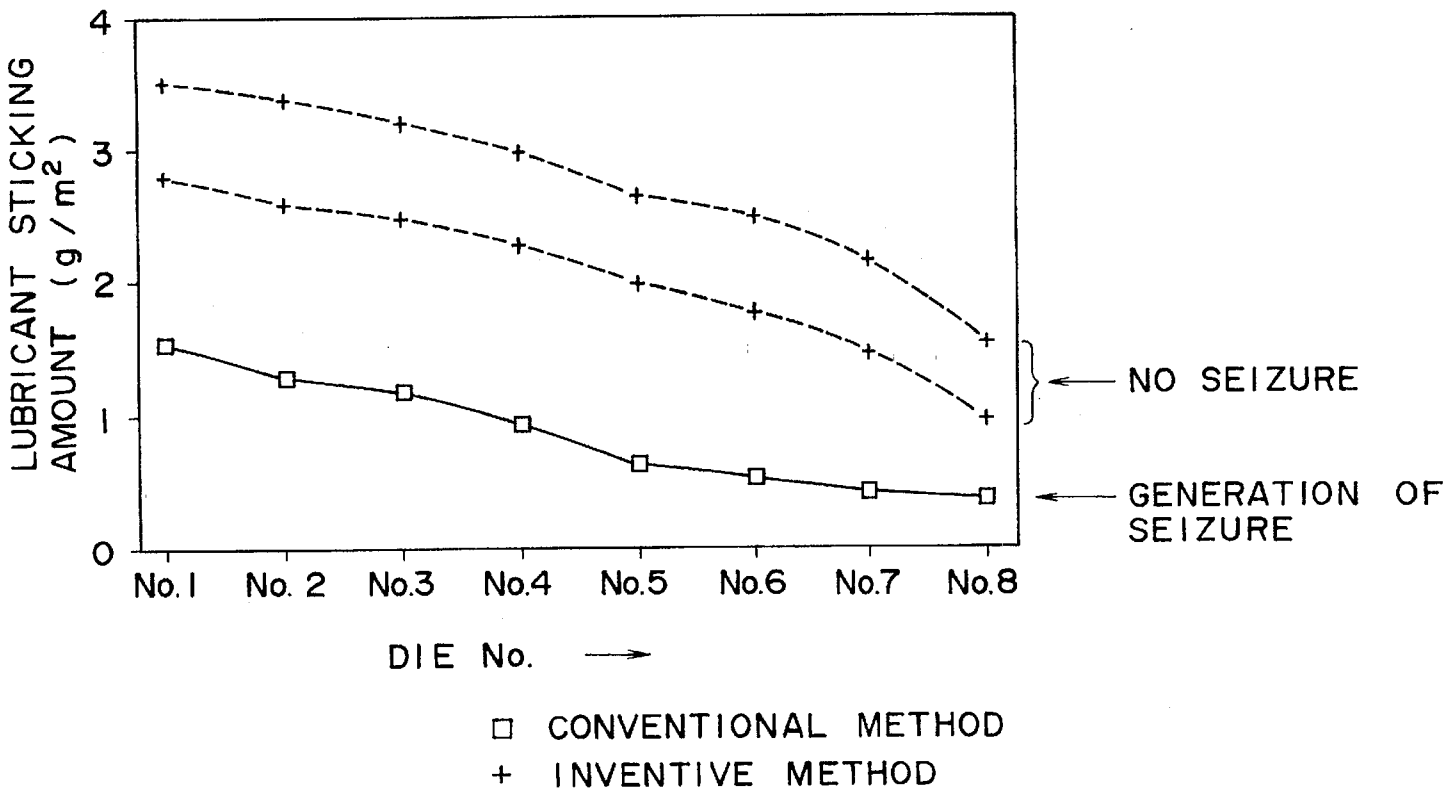
FIG. 15 is a graph comparing a metal wire imparted with a torsion in the inventive method with a metal wire treated in the conventional method in terms of the lubricant sticking amount.

FIG. 15 shows a comparison .in lubricant sticking amount between the conventional mechanical descaling and inventive mechanical descaling. As is apparent from FIG. 15, in the conventional method, a seizure is already generated at the No. 7 die (lubricant sticking amount: 0.5 g/m$^2$ or less); while in this embodiment, any seizure is not generated even at the No. 8 die (lubricant sticking amount: 1.0 g/m$^2$).

In FIG. 15, a difference between two curves obtained in this embodiment is dependent on variations in the drawing rate and lubricant temperature.

In this embodiment, since the metal wire 5 enters the die 52 while being distorted in the lubricant box 51, the lubricant LO is entrained to the die 52, thus increasing the entrainment amount of the lubricant to the No. 1 die. As a result, the lubricant sticking amount at the outlet of the No. 1 die is increased, and the lubricant sticking amount after the outlet of the No. 2 die is naturally increased as a whole, thus improving the drawing possible rate.

Figure 16:
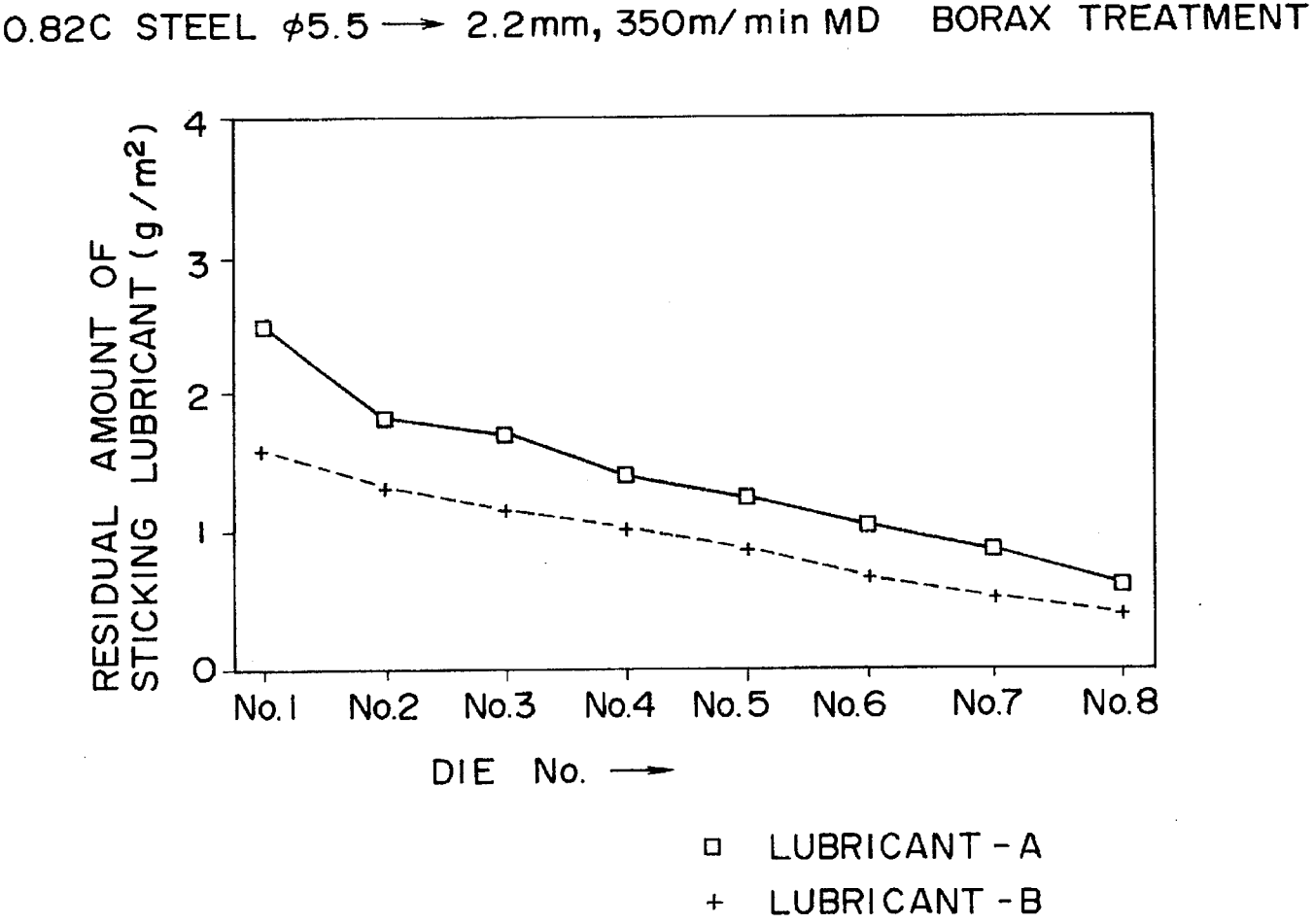
FIG. 16 is a graph showing the attenuation of a lubricant in a conventional drawing method.
Figure 17:
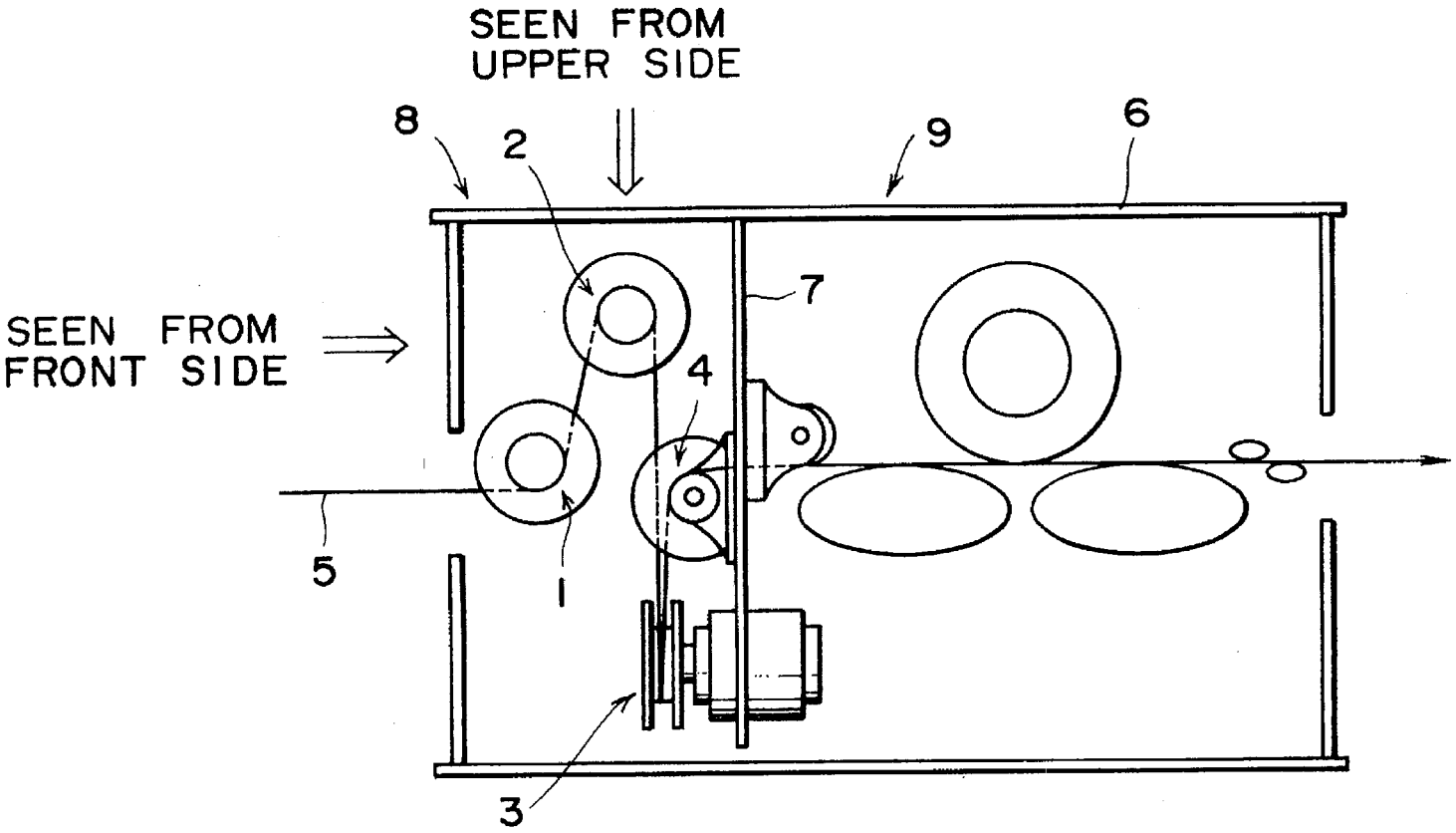
FIG. 17 is a view of a conventional reverse bending apparatus.
Figures 18A, 18B, 18C, 18D, 18E, 18F:
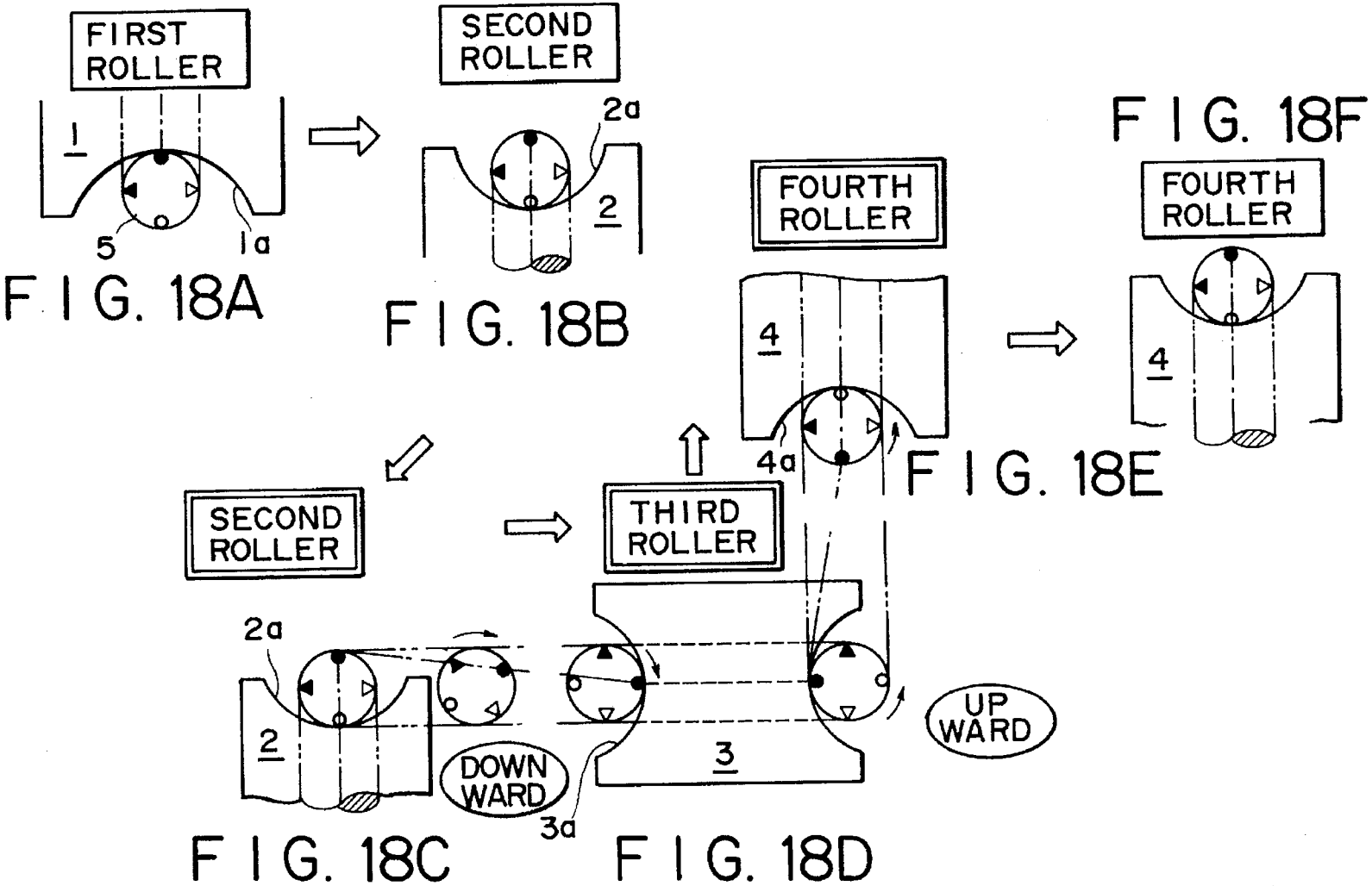
FIGS. 18A to 18F are illustrative view showing the shifting processes of a metal wire in a conventional reverse bending method.
Figure 19:
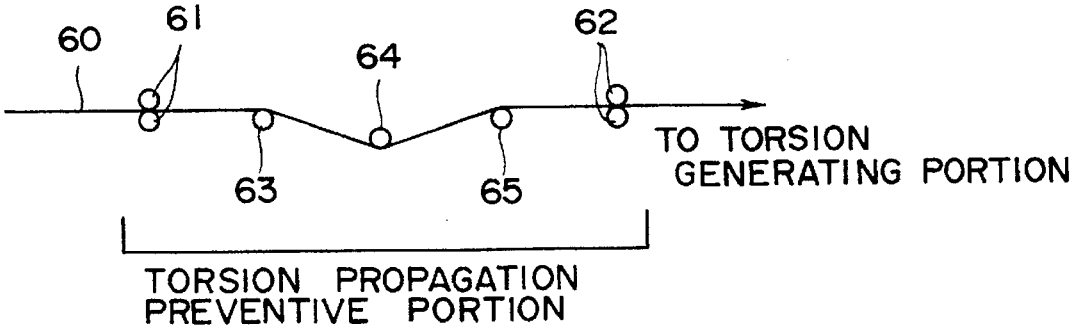
FIG. 19 is a view showing a conventional torsion propagation preventive mechanism.

FIG. 16 shows the relationship between the drawing degree and the lubricant sticking amount. As shown in this figure, in the conventional drawing for a high strength wire, the lubricant sticking amount is decreased with the progress of the drawing, to loss a role as a lubricant film layer, thus generating a seizure at the die in the final stage (No. 8 die in the figure). However, in the case of applying the mechanical descaling apparatus in this embodiment to the drawing machine, the attenuation of a lubricating effect with the progress of the drawing, to thereby prevent the die seizure. As a consequence, even a high strength material can be drawn at a high drawing rate.

What is claimed is:

1. A mechanical descaling method for removing scales on the surface of a metal wire, comprising the steps of:

running a metal wire;

passing said running metal wire through a torsion generating portion for forcibly turning said metal wire around the axial center thereof, thereby generating torsion in the running wire and removing scales due to a difference in toughness between said metal wire and scales; and preventing propagation of the torsion by passing the wire over first through third rollers in the direction of wire running, the rollers having centers disposed approximately in a triangular shape such that the wire is bypassed in approximately a U-shape, wherein the step of passing the wire over the third roller comprises passing the wire over a roller having a diameter of at least 120 mm.

2. The method of claim 1 wherein the step of passing the wire over the third roller comprises passing the wire over the third roller by an angle of at least 90°.

3. A mechanical descaling apparatus comprising:

a torsion generating portion for turning, a displacing/running portion for curvedly running a metal wire along the peripheral surface of a roller, around the axial center of said metal wire in the carrying direction; and a torsion propagation preventive portion for applying a restriction to said metal wire from a peripheral portion of said metal wire under the running state thereby preventing the propagation of a torsion, which is provided on the upstream side from said torsion generating portion, wherein said torsion propagation preventive portion has a first, second and third rollers whose axial centers are disposed approximately in a triangular shape so that said metal wire is bypassed approximately in a U-shape, and said third roller has a specified contact length with said metal wire, and wherein said specified contact length of said third roller is obtained by specifying the diameter of said third roller at 120 mm or more.

4. A mechanical descaling apparatus according to claim 3, wherein said torsion propagation preventive portion is provided on the downstream side from said torsion generating portion.

5. A mechanical descaling apparatus according to claim 3, wherein two of said torsion generating portions are provided along the running direction of said metal wire in such a manner that said torsion generating portion on the upstream side is turned in the reverse direction to that of said torsion generating portion on the downstream side at a speed lower than that of said torsion generating portion on the downstream side, thereby canceling the torsions obtained by said torsion generating portions on the upstream and downstream sides.

6. A mechanical descaling apparatus according to claim 5, wherein said torsion propagation preventive portion is provided on the downstream side from said torsion generating portion on the downstream side.

7. A mechanical descaling apparatus having a torsion generating portion for forcibly turning a metal wire around the axial center of said metal wire while running said metal wire thereby feeding said metal wire imparted with a torsion to a drawing machine, comprising:

a drawing rate detecting means for detecting a drawing rate of said metal wire in the range of from said torsion generating portion to said drawing machine;

a torsion amount storing means for previously storing a specified torsion amount; and a torsional rotation frequency control means for calculating a specified torsion rotational frequency on the basis of a drawing rate detected from said drawing rate detecting means and said torsion amount read out from said torsion amount storing means thereby rotating said torsion generating portion in accordance with said calculated torsional rotation frequency.

8. A mechanical descaling apparatus according to claim 7, wherein said torsion amount is a distance of said metal wire running for one rotation around the axial center of said metal wire.

* * * * *